US005788609A

United States Patent [19]

Miller

[11] Patent Number: 5,788,609

[45] **Date of Patent: *Aug. 4, 1998**

[54] COMPACT EXERCISE DEVICE

[76] Inventor: Larry Miller, 1628 Treeside, Rochester, Mich. 48307

[ * ] Notice: The term of this patent shall not extend beyond the expiration date of Pat. No. 5,562,574.

[21] Appl. No.: 726,762

[22] Filed: Oct. 7, 1996

Related U.S. Application Data

[63] Continuation of Ser. No. 598,370, Feb. 8, 1996, Pat. No. 5,562,574.

[51] Int. Cl.[6] ..... A63B 69/16; A63B 22/04

[52] U.S. Cl. ..... 482/51; 482/57

[58] Field of Search ..... 482/52, 51, 53, 482/57, 58, 70, 110, 148, 62

[56] References Cited

U.S. PATENT DOCUMENTS

| | | | |
|---|---|---|---|
| 2,603,486 | 7/1952 | Hughes | 272/79 |
| 4,509,742 | 4/1985 | Cones | 272/73 |
| 5,039,088 | 8/1991 | Shifferaw | 272/73 |
| 5,279,529 | 1/1994 | Eschenbach | 482/57 |
| 5,290,211 | 3/1994 | Stearns | 482/53 |
| 5,352,169 | 10/1994 | Eschenbach | 482/57 |
| 5,383,829 | 1/1995 | Miller | 482/57 |
| 5,499,956 | 3/1996 | Habing | 482/51 |
| 5,562,574 | 10/1996 | Miller | 482/52 |

*Primary Examiner*—Stephen R. Crow

*Attorney, Agent, or Firm*—Gifford, Krass, Groh, Sprinkle, Patmore, Anderson & Citkowski,P.C.

[57] ABSTRACT

A compact exercise device includes a pair of crank arms pivotably supported on a frame for rotation about a pivot axis. Each crank arm engages a respective intermediate link at its first end. A second end of each intermediate link travels on a guide member so that as the crank arms rotates, the first end of each intermediate link traces an arcuate path, and the second end of each intermediate link traces a reciprocating path. The device includes a pair of foot links, each foot link is coupled, through a first end thereof, to a respective one of said intermediate links at a point between the first and second ends thereof; a second end of each foot link engages another guide member which directs it along a preselected path of travel, as the intermediate link is moved by the crank arm. The device provides a range of foot and leg motion simulating a natural running and stepping action.

19 Claims, 3 Drawing Sheets

36

12
10
16
18b
22b
14
30a
20
18a
32a
24b
34
34
26a
28a
22a
24a 40
42
46
44b
44a
16
14
18a
28a
22a
24a
26a

COMPACT EXERCISE DEVICE

This is a continuation of applications Ser. no. 08/598,370 filed Feb. 8, 1996, now U.S. Pat. No. 5,562,574.

FIELD OF THE INVENTION

This invention relates generally to exercise equipment. More specifically, the invention relates to a compact, stationary exercise device for simulating running and stepping motions.

BACKGROUND OF THE INVENTION

Because of a growing appreciation for the benefits of regular exercise; and because constraints of time and space prevent many persons from indulging in activities such as running, swimming and walking, the market for exercise equipment is rapidly increasing. It is generally desirable to exercise a number of different muscles over a fairly large range of motion so as to provide for even physical development and a maximum level of aerobic exercise. It is further desirable that exercise equipment provide a smooth, relatively natural motion so as to avoid jarring or irregular strains which can damage muscles and joints. It is also desirable that exercise equipment be relatively easy to use and of simple, low cost construction.

While a number of different exercise systems are known in the prior art, such systems suffer from a number of shortcomings which limit their utility. Stationary bicycles are widely used; however, they are employed in a sitting position and consequently, the number of muscles exercised is small. Furthermore, the range of motion provided by a stationary bicycle is fairly limited. Stationary devices for simulating cross country skiing are also in widespread use. While these systems exercise more muscles than do stationary bicycles, the relatively flat, shuffling foot motion provided thereby does not adequately exercise all of the leg muscles through a wide range of motion. Stair climbing equipment also exercises more muscles than do stationary bicycles; however, the rather limited up and down motion provided thereby does not exercise leg muscles through a large range of motion. Treadmills and the like permit walking or jogging in a relatively limited area; however, they can be quite jarring to knee and ankle joints, and many users find it difficult to maintain balance on a treadmill.

U.S. Pat. No. 4,720,093 shows a climbing type exerciser. U.S. Pat. 4,509,742 shows a stationary bicycle which provides for arm motion. U.S. Pat. No. 2,603,486 shows a bicycle type exerciser providing for combined arm and leg motions. U.S. Pat. No. 5,039,088 shows another bicycle type exerciser providing for hand motion.

U.S. Pat. No. 3,316,898 discloses a rehabilitation device for passive use by a seated person. The device includes a motor which raises and lowers a set of foot supporting plates so as to flex the ankle, knee and hip joints. A similar device is shown in U.S. Pat. No. 4,185,622. German Laid Open Publication 29 19 494 discloses an exercise device in which a set of foot supporting plates is disposed so as to undergo a combination of sliding and rotary motion to provide a stepping action. It has been found that while these apparatus produce a stepping motion, the motion does not simulate natural running and walking.

In response to the shortcomings of the prior art, the inventor of the present invention has previously developed a stationary exercise device which is disclosed in U.S. Pat. Nos. 5,242,343; 5,383,829, and application Ser. No. 08/407,272. The apparatus of the foregoing patents provides a natural running and stepping motion in which the user's heel initially rises at a faster rate than the toe, on a forward step, and in which the heel initially falls at a faster rate than the toe on a backward step. The present invention is directed to an exercise device which is configured differently from those in U.S. Pat Nos. 5,242,343; 5,383,829 and application Ser. No. 08/407,272, but which achieves a similar, beneficial foot action. Furthermore, the apparatus of the present invention is relatively compact, making it particularly advantageous for use in limited space areas such as the home.

The apparatus of the present invention is simple to manufacture and use, compact in design, and provides a smooth, natural action which exercises a relatively large number of muscles through a large range of motion. These and other advantages of the present invention will be readily apparent from the drawings, discussion and description which follow.

BRIEF DESCRIPTION OF THE INVENTION

There is disclosed herein a compact exercise device which includes a frame configured to be supported on a floor and having a first pivot axis defined thereupon. A first and second crank arm are pivotally attached to the frame at the first pivot axis so as to be rotatable thereabout. A first and a second intermediate link each have a first end thereof coupled to a respective one of the crank arms so that the first end of each intermediate link travels in an arcuate path about the first pivot axis as the crank arms rotate thereabout. The apparatus further includes a first and second guide member, each disposed so as to engage a respective one of the intermediate links and to direct the second end of the intermediate link along a reciprocating path of travel as the first end thereof travels in the arcuate path. The apparatus still further includes a first and a second foot link, each with a first and second end, together with a first and a second connector, each operative to pivotally connect the first end of a respective one of the foot links to one of the intermediate links so that the first end of each of the foot links travels along a first preselected path as the second end of the intermediate link to which it is attached travels along the reciprocating path. The apparatus includes a third and a fourth guide member each disposed so as to engage a respective one of the first and second foot links and to direct the second end of each of said foot links along a second preselected path of travel as the first ends of said foot links travel along said first preselected path.

In one particular embodiment the third and fourth guide members each comprise an elongated member which is pivotably attached to the frame at or near a first one of its ends and which is pivotably attached to the second end of a respective foot link at or near its other end. In yet another embodiment, the third and fourth guide members each comprise a track which engages and directs the second end of a respective foot link. In yet another embodiment, the third and fourth guide members each comprise a roller element, pivotably supported on the frame, which roller element engages and directs a foot link. The device may be configured so that the third and four guide members direct the foot links along an inclined path of travel, relative to the floor, and the device may further include adjustment means so that this inclined path of travel may be varied.

In some embodiments, the exercise device may include a flywheel mechanically engaged to the first and second crank arms. The flywheel may be supported at the first pivot axis, or at a location separate from the first pivot axis, in which instance it will be mechanically coupled to the crank arms.

DETAILED DESCRIPTION OF THE INVENTION

The present invention is directed to a compact exercise device which moves a user's feet and legs through a natural range of motions associated with running and stepping. The device includes a folded linkage of compact design. The device may be fabricated in a number of configurations, and various representatives thereof are illustrated herein.

Figure 1:
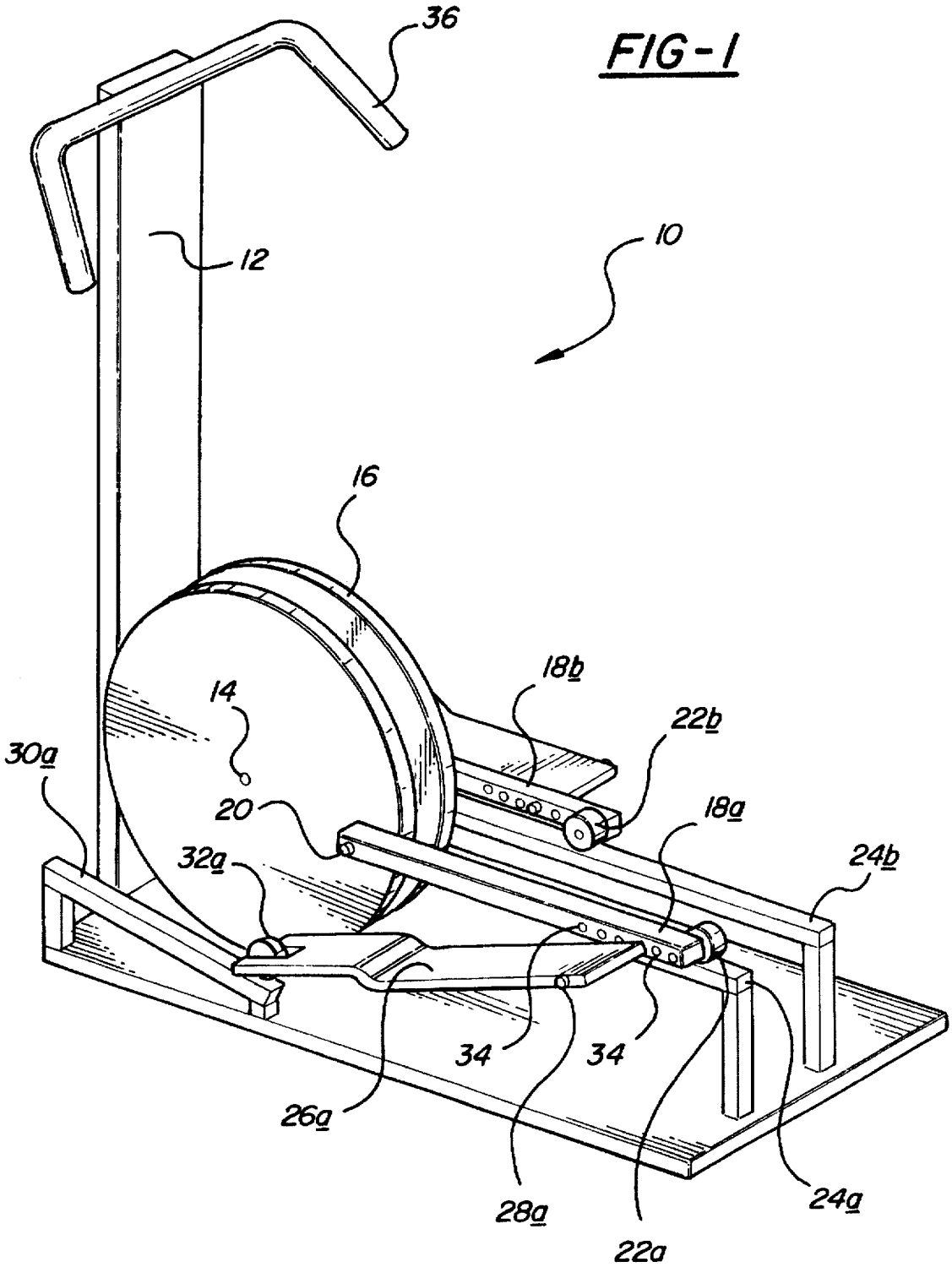
FIG. 1 is a perspective view of a first embodiment of an exercise device structured in accord with the principles of the present invention.

Referring now to FIG. 1, there is shown a perspective view of a first embodiment of exercise device 10 structured in accord with the principles of the present invention. Exercise device 10 includes a frame 12 which is configured to be supported on a floor, and which supports and retains the components of the exercise device. The frame 12 has a first pivot axis 14 defined thereon, and in the illustrated embodiment a flywheel 16 is supported at the first pivot axis 14 for rotation thereabout. As illustrated, the flywheel 16 is a split flywheel having a center axle (not shown) passing through the pivot axis 14. The center axle in turn is supported by a support post (not shown) which engages the base of the frame 12. A first intermediate link 18*a* and a second intermediate link 18*b* each have a first end which is pivotably coupled to the flywheel 16. As illustrated, the first intermediate link 18*a* is coupled to the flywheel 16 by a pin 20 passing therethrough. Although not visible, a similar arrangement couples the second intermediate link 18*b* to the flywheel. The portion of the flywheel between the pivot axis 14 and the connector pin 20 defines a crank arm having one end fixed at the pivot axis 14 and the other at the connector pin 20. As this crank arm rotates about the first pivot axis 14, it causes a first end of each of the intermediate links 18*a*, 18*b* to travel about the pivot axis 14 in an arcuate path. It is to be understood that while a flywheel 16 is illustrated, a simple set of crank arms (used either alone or with a flywheel) may be similarly employed. A second end of each of the intermediate links 18*b* engages a respective one of first and second guide members 24*a*, 24*b*. As specifically illustrated, intermediate link 18*a* engages guide member 24*a* via roller 22*a*, and intermediate link 18*b* engages guide member 24*b* through roller 22*b*. The first and second guide members 24*a*, 24*b* operate to direct the second ends of the intermediate links 18*a*, 18*b* in a reciprocating path of travel, as the first ends thereof travel along the arcuate path. While the first and second guide members 24*a*, 24*b* are illustrated as being straight rails disposed parallel to the floor, the guide members may be otherwise configured. For example, the guide members may be curved rails, or they may be inclined relative to the base of the frame 12. Other configurations of first and second guide may also be employed. For example, the guide members may comprise troughs or variously configured support linkages. In some instances, a single, relatively wide member will suffice to guide both intermediate links, and will function as the first and second guide members.

The exercise device 10 of FIG. 1 includes a pair of foot links, only one of which, 26*a*, is visible in this drawing, it being understood that the other is a mirror image thereof. The foot link 26*a* is configured to receive and support the foot of a person utilizing the exercise device. A first end of the foot link 26*a* is pivotably connected to its respective intermediate link 18*a* via a connector pin 28*a*. The second end of the foot link 26*a* engages a third guide member 30*a*, which in this instance comprises a guide rail which is inclined relative to the floor. As illustrated, the foot link 26*a* engages the guide rail 30*a* via a roller 32*a* disposed at the second end of the foot link 26*a*. A similar arrangement is provided with regard to the second foot link.

In the operation of the illustrated embodiment of exercise device 10, the flywheel 16 rotates about the first pivot axis 14 causing the first ends of the intermediate links 18 to move in the aforedescribed arcuate path. The second ends of the intermediate links 18 move in a reciprocating path as defined by the first and second guides 24*a*, 24*b*. This action causes the foot links 26 to also move. The first end of each of the foot links 26 is coupled to its respective intermediate link 18, at a point between the first and second ends thereof, and as a consequence, the first end of the foot link 26*a* will travel in a rising and falling path of motion defining a closed, oval loop such that the highest point in its path of travel occurs when the first end of its respective intermediate link is at the highest vertical distance from the first pivot axis 14. Conversely, the first end of the foot link 26*a* will be at its lowest point when the first end of its respective intermediate link is at the lowest vertical distance from the first pivot axis 14. The second end of the foot link 26*a* will correspondingly travel along the third guide 30*a* in an upwardly inclined path of travel. This combination of motions produces a very natural foot action corresponding to a natural running and stepping motion. Typically, the user's heel will initially rise at a faster rate than the toe as a forward step begins, and will initially fall at a faster rate than the toe on a backward step.

The attachment point of the foot link 26*a* to its respective intermediate link 18*a* may be adjusted. In the illustrated embodiment, the connector pin 28*a* may be placed in any one of a series of holes 34 defined in the intermediate link 18*a*. Clearly, other adjustment mechanisms will be readily apparent to one of skill in the art, including slotted connectors and the like. The third and fourth guides, for example 30*a*, may also be made adjustable so that the angle thereof relative to the floor may be varied. Also, while the guide rail 30*a* is illustrated as being a straight rail, it may also be curved so as to further modify the foot action.

As illustrated, the device 10 of FIG. 1 further includes a set of hand grips 36. The apparatus 10 may further include auxiliary equipment such as an electronic or a mechanical indicator coupled to the flywheel to indicate speed, distance, duration or effort expended by the user in the operation of the exercise device. It is also anticipated that the device may include an adjustable braking system such as a magnetic, electronic or mechanical brake for imposing a controlled drag on the operation of the apparatus so as to selectively control the level of exercise achieved therewith. All of such modifications and variations are within the scope of the present invention.

Figure 2:
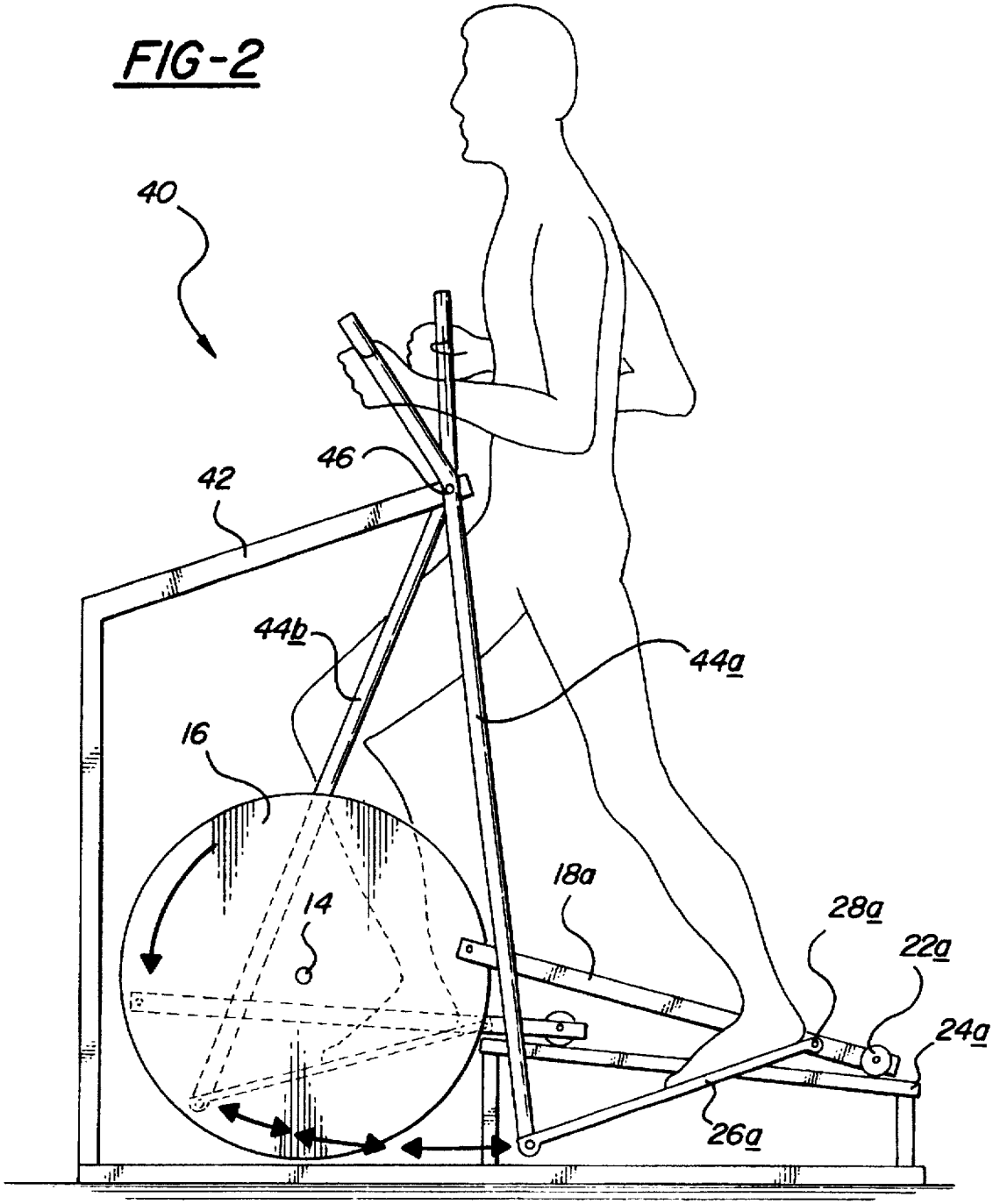
FIG. 2 is a side elevational view of a second embodiment of an exercise device structured in accord with the principles of the present invention.

Referring now to FIG. 2, there is shown another embodiment of exercise device 40 structured in accord with the present invention. Device 40 of FIG. 2 includes a frame 42 having a first pivot axis 14 defined thereupon. A flywheel 16, generally similar to the flywheel previously described, is supported on the frame by a central pillar, not shown. As in the previous embodiment, a first intermediate link 18*a* has a first end thereof pivotably connected to the flywheel 16. A second end of the intermediate link 18*a* contacts a first guide rail 24*a* via a roller 22*a*, as previously described.

The exercise device 40 of FIG. 2 includes a set of foot links, one of which, 26*a*, is visible in this depiction. The first end of the foot link 26*a* is pivotably connected to the first intermediate link 18*a* by a connector pin 28*a*. In general, the foregoing arrangement of elements is generally similar to that shown in FIG. 1.

The FIG. 2 embodiment 40 differs from that of FIG. 1 insofar as the third and fourth guide members in this embodiment each comprise a generally elongated member 44*a*, 44*b*. Each of the elongated members, 44, comprising the third and fourth guides are pivotably attached, at a first pivot point thereof, to a second pivot axis 46, defined upon the frame 42, so as to be pivotable about the second pivot axis 46. Each of the elongated members is also pivotably attached to the second end of its respective foot link, and as illustrated, elongated member 44*a* is pivotably attached to the second end of foot link 26*a*. The elongated members 44 function as the third and fourth guides to direct the second end of the foot links 26 along a generally curved path which is inclined relative to the floor. In this manner, the guides 44 of the FIG. 2 embodiment function in a manner analogous to the guides 30 of the FIG. 1 embodiment, and a similar, beneficial foot and leg action is achieved. Although not illustrated, it is to be understood that the attachment point of the elongated members 44*a* to the foot links 26*a* may be varied, as is known in the art, and will thereby modify the foot action achieved by the device. As illustrated, the elongated members include a slight bend therein proximate their attachment point to the second pivot axis 46, and this bend will, in some instances, serve to modify and improve the hand action achieved by the device in use. It is to be noted that the extension portions of the elongated members 44*a* may be dispensed with, and a fixed hand grip substituted therefor. All of such modifications and variations are within the scope of the present invention.

Figure 3:
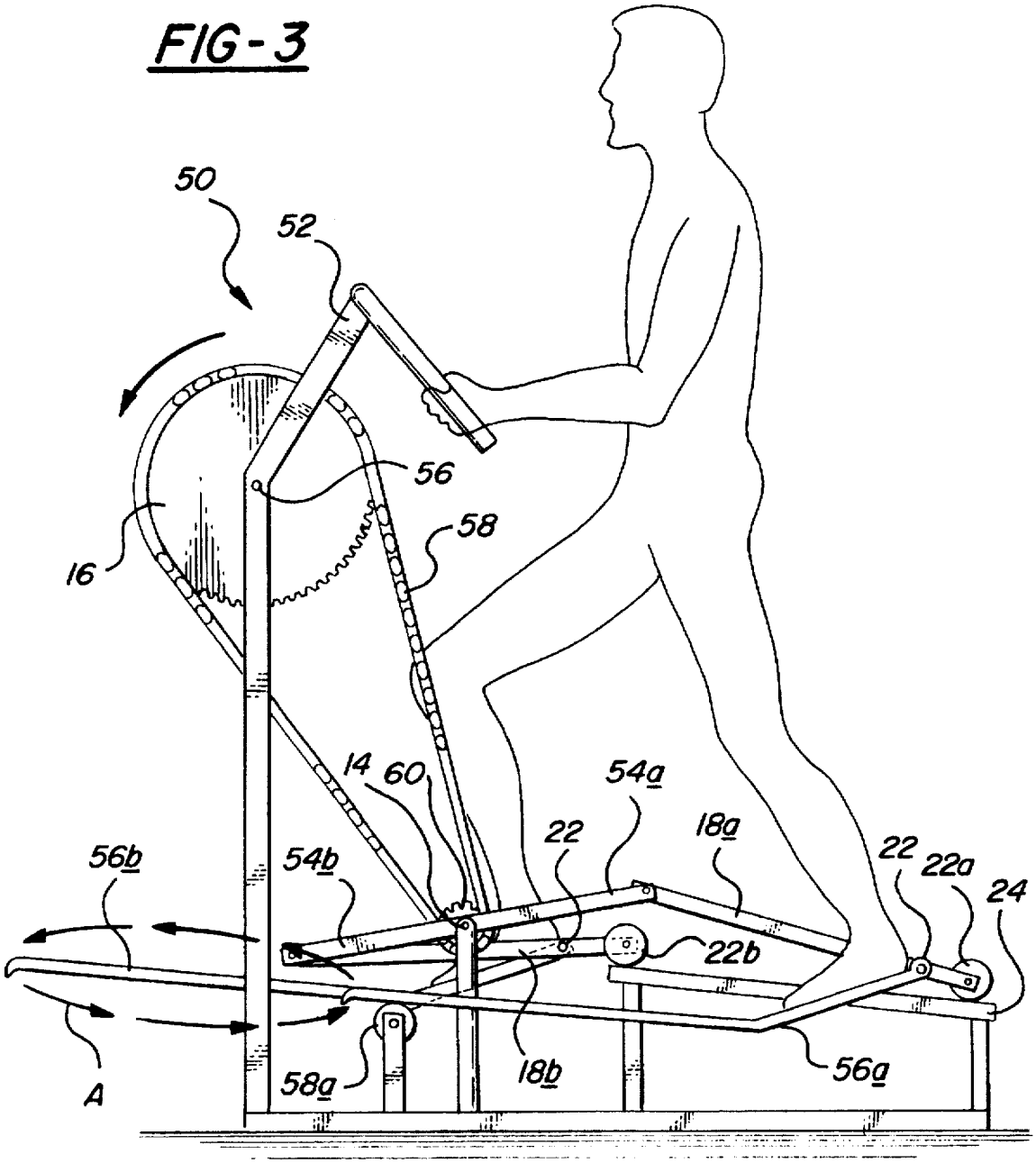
FIG. 3 is a side elevational view of a third embodiment of an exercise device structured in accord with the principles of the present invention.

Referring now to FIG. 3, there is shown yet another embodiment 50 of exercise device structured in accord with the present invention. Device 50 of FIG. 3 differs from that of FIG. 2 and FIG. 1 in several regards. The FIG. 3 apparatus includes a first pivot axis 14 defined upon the frame 52, but does not include a flywheel mounted at the first pivot axis 14. Instead, a pair of crank arms 54*a*, 54*b* are disposed for rotation about the pivot axis 14. In the illustrated embodiment, a flywheel 16 is supported on the frame 52 at a third pivot axis 56 separate from the first pivot axis 14. The flywheel is mechanically coupled to the crank arms 54*a*, 54*b* by a drive chain 58 which engages a corresponding drive wheel 60 associated with the crank arms 54*a*, 54*b*.

As in the previous embodiments, the device 50 of FIG. 3 includes a first intermediate link 18*a* and a second intermediate link 28*b* as previously described. A first end of each intermediate link 18 is pivotably coupled to a respective crank arm 54 so as to define an arcuate path about said pivot axis 14 as said crank arms 54 rotate thereabout. A second end of each intermediate link 18 engages a guide track 24 via a roller 22, as previously described.

The apparatus 50 of FIG. 3 includes a first and second foot link 56*a*, 56*b*. As in the previous embodiments, the first end of each of the foot links 56 is connected to its respective intermediate link 18 by a connector 22. However, the second end of each of the foot links 56 is a free end. In the apparatus 50 of FIG. 3, the second and third guides each comprise a roller element supported by the frame 52. In the FIG. 3 illustration, only one of the rollers, 58*a*, is visible, and this roller 58*a* comprises the third guide member. A fourth guide member is comprised by a similar roller. The roller 58*a* engages its respective foot link 56*a* so that the foot link 56*a* glides thereacross, as the associated intermediate link 18*a* moves under the influence of its respective crank arm 54*a*. In this manner, the roller 58*a* directs the second end of the foot link 56*a* along a preselected path of travel, which defines a generally closed, oval shape indicated by arrows A. It will be noted that in the illustrated embodiment, the foot links 56*a*, 56*b* are bent, and this bend optimizes the foot action achieved thereby, although it is to be understood that in some instances, the foot links 56 may be configured as straight foot links, and may further include wedge shaped foot retaining portions for adjusting the angle of the user's foot. In other instances, adjustment of the user's foot angle may be achieved by adjusting the relative position of the roller 58 and track 24, and all of such modifications and variations are within the scope of the present invention.

Yet other modifications may be made to the FIG. 3 embodiment. For example, the roller 58*a* may be replaced by a sliding contact or the like. The apparatus may be modified to place the flywheel 16 at the first pivot axis 14, and in such instance, the crank arms 54 may be eliminated provided the flywheel is of sufficient diameter to assure proper action of the guide links 18. As in previous embodiments, further equipment such as dynamic braking systems, odometers or other such monitors may be incorporated into the apparatus. As in all the previous embodiments, the connection points between the various linkages may be made adjustable so as to permit customizing and modification of the action achieved thereby. Similarly, height adjustments may be included for varying the positional relationship of the guides and links. In yet other instances, a motorized drive may be associated with the device for providing passive exercise, and such embodiments are particularly suited for rehabilitative and geriatric applications.

In view of the foregoing, it is to be understood that numerous modifications and variations of the aforedescribed apparatus may be implemented in accord with the teachings herein. The foregoing drawings, discussion and description are merely meant to illustrate particular embodiments of the invention, and are not meant to be limitations upon the practice thereof. It is the following claims, including all equivalents, which define the scope of the invention.

I claim:

1. A compact exercise device comprising:

a frame having a first pivot axis defined thereon;

a first and a second guide link, each guide link having a first and a second end portion, the first end portion of each guide link being coupled to the first pivot axis so that the first end of each guide link travels in an arcuate path about said first pivot axis;

first and second guides, each being disposed so as to guide a second end portion of said respective guide link along a reciprocating path of travel as the first end thereof travels in said arcuate path about said first pivot axis;

a first and a second foot link, each having a first and a second end portion, the first end portion of each of said foot links being pivotally connected to a respective one of said first and second guide links, so that said first end portion of each of said foot links travels along a first preselected path as the second end of its respective guide link travels along said reciprocating path; and third and fourth guides, each being disposed so as to guide the second end of each of said foot links along a second preselected path of travel as the first ends of said foot links travel along said first preselected path of travel.

2. An exercise device as in claim 1, wherein said frame includes a second pivot axis defined thereupon, and wherein said third and fourth guides each comprise connector members having a first and second pivot point defined thereupon, each of said third and fourth guides being pivotally attached through the first pivot point thereof to the second pivot axis of said frame, and through the second pivot point thereof to the second end portion of a respective one of said first and second foot links.

3. An exercise device as in claim 2, wherein the connector members comprising the third and fourth guides having extension portions extending beyond the first pivot points thereon in a direction generally away from the second pivot point thereon.

4. An exercise device as in claim 3, wherein the extension portions of the connector members having portions positioned to be manually graspable when standing on the foot links.

5. An exercise device as in claim 1, wherein said second preselected path of travel is an inclined path of travel relative to a floor and wherein said third and fourth guides guide the second end portion of a respective one of the first and second foot links along said inclined path of travel.

6. An exercise device as in claim 5, further including adjustment means associated with the third and fourth guides for varying a degree of inclination of the inclined path of travel relative to the floor.

7. An exercise device as in claim 1, further including a flywheel in mechanical engagement with the first end portions of the guide links.

8. An exercise device as in claim 7, wherein said flywheel is supported by said frame at said first pivot axis.

9. An exercise device as in claim 7, wherein said flywheel is supported at a third pivot axis, separate from said first pivot axis, and is mechanically coupled to the first end portions of the guide links.

10. An exercise device as in claim 7, wherein said flywheel is supported at said first pivot axis, and wherein the first end portions of the guide links are coupled to said flywheel.

11. An exercise device as in claim 1, wherein said first, second, third and fourth guide members comprise tracks.

12. An exercise device as in claim 1, further including a variable resistance braking assembly in mechanical communication with said guide links for providing a variable resistance to the movement thereof.

13. The exercise device as in claim 1, wherein the first and second guides guide the second end portion of said respective guide link along a closed, arcuate path of travel as the first end of the guide link travels in an arcuate path about the first axis.

14. An exercise device as in claim 1, wherein said first and second guide links are configured so that the first end portions of the first and second foot links may be selectably connected to a respective one of said first and second guide links at a plurality of locations thereupon.

15. An exercise device as in claim 14, wherein the first end portions of the first and second foot links may be selectively connected to a respective one of the first and second guide links at varying distances from the first pivot axis.

16. An exercise device as in claim 1, wherein said third and fourth guides each comprise a rotatable member pivotably attached to the frame.

17. A compact exercise device comprising:

a frame configured to be supported on a floor and having a first pivot axis defined thereupon;

a first and a second crank arm, each crank arm being pivotably attached to the frame at said first pivot axis so as to be rotatable thereabout;

a first and a second guide link, each guide link having a first and a second end, the first end of each guide link being coupled to a respective one of said first and second crank arms so that the first end of each of said guide links travels in an arcuate path about said first pivot axis as said crank arms rotate thereabout;

a first and a second guide, each guide being disposed so as to engage a respective one of said guide links and to direct a second end of said respective guide link along a reciprocating path of travel as the first end thereof travels in said arcuate path;

a first and a second foot support, each having a first and a second end portion;

a first and a second connector, each being operative to pivotably connect the first end of each of said foot supports to a respective one of said first and second guide links at a point thereupon between the first and second ends thereof, so that said first end of each of said foot supports travels along a generally arcuate, closed path as the second end of its respective guide link travels along said reciprocating path;

a third and a fourth guide, each disposed so as to engage the second end portion of a respective one of said first and second foot supports, and to direct the second end of each of said foot supports along a second reciprocating path of travel as the first ends of said foot supports travel along said closed, arcuate path of travel.

18. An exercise device as in claim 17, wherein the arcuate path of travel of the first end portions of the foot supports define a generally oval closed path of travel.

19. An exercise device as in claim 17, wherein said frame includes a second pivot axis defined thereupon and wherein said third and fourth guides each having a first and second pivot point defined thereupon, each of said third and fourth guides being pivotably attached through the first pivot point thereof to the second pivot axis of said frame, and through the second pivot point thereof to the second end of a respective one of said first and second foot supports.

* * * * *